US005966843A

United States Patent [19]

Sand et al.

[11] Patent Number: 5,966,843

[45] Date of Patent: Oct. 19, 1999

[54] SNOWBOARD BOOT ANKLE SUPPORT DEVICE

[75] Inventors: Jeff W. Sand; Erik Anderson, both of San Francisco, Calif.

[73] Assignee: Vans, Inc., Santa Fe Springs, Calif.

[21] Appl. No.: 09/232,128

[22] Filed: Jan. 15, 1999

Related U.S. Application Data

[62] Division of application No. 08/788,175, Jan. 24, 1997, Pat. No. 5,894,687

[60] Provisional application No. 60/011,151, Jan. 26, 1996.

[51] Int. Cl.[6] ..... A43B 5/04; A43B 7/20

[52] U.S. Cl. ..... 36/117.1; 36/118.8; 36/118.7; 36/118.2; 36/115; 36/89

[58] Field of Search ..... 36/89, 115, 117.5, 36/92, 55, 117.1, 118.2, 118.4, 118.7, 118.8

[56] References Cited

U.S. PATENT DOCUMENTS

| | | | |
|---|---|---|---|
| 2,546,694 | 10/1950 | Johansen . | |
| 3,313,046 | 4/1967 | Werner et al. . | |
| 3,530,594 | 9/1970 | Vogel . | |
| 3,597,862 | 8/1971 | Vogel . | |
| 3,807,062 | 4/1974 | Spier . | |
| 4,006,543 | 2/1977 | Post . | |
| 4,523,394 | 6/1985 | Lindh et al. . | |
| 4,955,149 | 9/1990 | Ottieri . | |
| 4,979,760 | 12/1990 | Derrah . | |
| 5,056,509 | 10/1991 | Swearington . | |
| 5,090,138 | 2/1992 | Borden . | |
| 5,172,924 | 12/1992 | Barci . | |
| 5,190,311 | 3/1993 | Carpenter et al. . | |
| 5,317,820 | 6/1994 | Bell et al. . | |
| 5,356,170 | 10/1994 | Carpenter et al. . | |
| 5,401,041 | 3/1995 | Jespersen . | |
| 5,408,763 | 4/1995 | Sartor et al. . | |
| 5,409,244 | 4/1995 | Young . | |
| 5,416,952 | 5/1995 | Dodge . | |
| 5,433,636 | 7/1995 | Gillis . | |
| 5,435,080 | 7/1995 | Meiselman . | |
| 5,452,907 | 9/1995 | Meibock et al. . | |
| 5,499,461 | 3/1996 | Danezin et al. | 36/117.1 |
| 5,544,909 | 8/1996 | Laughlin et al. . | |
| 5,669,160 | 8/1997 | Pozzebon . | |
| 5,678,330 | 10/1997 | Van Dyke et al. . | |
| 5,701,689 | 12/1997 | Hansen et al. | 36/117.1 |
| 5,771,609 | 6/1998 | Messmer . | |
| 5,842,293 | 12/1998 | Young | 36/115 |
| 5,887,886 | 3/1999 | Bourdeau | 36/118.2 |
| 5,894,684 | 4/1999 | Sand et al. | 36/117.1 |
| 5,901,469 | 5/1999 | Saillet | 36/118.2 |

FOREIGN PATENT DOCUMENTS

| | | | |
|---|---|---|---|
| 1019145 | 10/1977 | Canada | 36/118.8 |
| 2 702 935 A1 | 9/1994 | France . | |
| 2 722 371 A1 | 1/1996 | France . | |
| 36 22 746 A1 | 1/1988 | Germany . | |
| 43 33 503 C2 | 7/1995 | Germany . | |
| 620260141 | 5/1992 | Italy . | |
| WO94/26365 | 11/1994 | WIPO . | |

OTHER PUBLICATIONS

Advertisement for Blax I–Spine, publication date unknown, circa Jan. 1996.

*Primary Examiner*—Paul T. Sewell
*Assistant Examiner*—Anthony Staschick
*Attorney, Agent, or Firm*—Feix & Feix

[57] ABSTRACT

An improved soft style snowboard boot which is internally reinforced by a multi-piece boot support assembly that includes a rigid molded plastic shank portion, a semi-rigid molded heel cup portion, and a molded or die-cut plastic highback portion. The shank portion is designed to resist flex, and provide ergonomic support for the foot, and further includes molded-in features which permit positive mechanical fastening of conventional step-in binding attachment structure, to the outsole of the boot. A pair of length adjustable tensioning strap members are connected between the shank and highback portions and when tightened the straps induce a desired forward lean in the highback portion. The straps may be tightened independently of each other to provide a desired side bias, left or right, to the highback portion. In one embodiment, the straps are contained within the outer boot portion. In another embodiment, the straps are routed exteriorly of the outer boot portion for more convenient forward lean adjustment. In another embodiment, a linerless snowboard both with adjustable ankle support is disclosed. In still another embodiment, an all exterior version of the boot support assembly for a soft style snowboard boot is disclosed.

8 Claims, 19 Drawing Sheets

SNOWBOARD BOOT ANKLE SUPPORT DEVICE

RELATED U.S. APPLICATIONS

This application is a divisional of Ser. No. 08/788,175, filed Jan. 24, 1997 now U.S. Pat. No. 5,894,687 issued Apr. 20, 1999. This application claims benefit of provisional application 60/011,151, filed Jan. 26, 1996. The application Ser. No. 08/292,485, filed Aug. 18, 1994, now U.S. Pat. No. 5,520,406, issued May 28, 1996, entitled "Snowboard Binding", Anthony Guerrero, Erik Anderson, and Jeff Sand inventors, is incorporated by reference in this application.

The application Ser. No. 08/489,167, filed Jun. 9, 1995, entitled "Snowboard Boot and Binding Apparatus", Anthony Guerrero, Erik Anderson, and Jeff Sand inventors, is also incorporated by reference in this application.

TECHNICAL FIELD

The present invention relates generally to improvements in "soft" style snowboard boots of the kind that include binding attachment structure, such as a bail or cleat, for use in combination with step-in snowboard bindings. More particularly, the present invention relates to a soft style snowboard boot that is reinforced with internal ankle support structure that is effective to lock out forward extension movement of the snowboard rider's ankles and which is adjustable to provide a desired amount of forward lean to the boot.

BACKGROUND OF THE INVENTION

Conventional strap bindings for snowboards include a highback for supporting the calf region of the snowboarder. This highback structure effectively locks out the forward extension movement of the ankle, thus allowing the forces from the rider's legs to transfer directly into the heel side edge of the snowboard. Without this highback structure, the rider's leg muscles would have to lock out the ankle in order to "tip" the board onto its heel side edge in order to make a heel side turn.

Snowboard boots generally come in two varieties; soft boots and hard boots. Hard boots are generally limited to use in combination with plate bindings. Soft boots are widely used with strap bindings and they are very popular with snowboarders since they are easy to fit and are comfortable both on and off the snowboard.

With the advent of step-in bindings for snowboards, the external highback structure of the binding is eliminated. Unfortunately, the ankle support capability of conventional soft style snowboard boots is insufficient, in most cases, to provide effective support to the rider's ankle and lock out the forward extension of the rider's ankle movement. The ability of a snowboard boot and/or snowboard binding to effectively lock out a specific range of movement of the ankle is critical to the positive feel and turning control of the snowboard.

Accordingly, it would be desirable to internally reinforce a soft style snowboard boot so that it could provide the necessary ankle movement lock out and support functions associated with conventional highback strap bindings. Further, it would be desirable to provided such a reinforced soft boot which also retains the comfort and fit features associated with conventional soft style snowboard boots. As can be readily appreciated by anyone of ordinary kill in the art, the above noted design considerations are in conflict with each other.

Others have proposed to solve this problem in various ways. For example, published European Patent application EP 0 646 334 A1 discloses a soft boot insert which includes a heel cup/foot bed portion which is pivotally connected to an upper highback portion. Straps are connected between the highback portion to the lower foot bed portion adjacent both sides of the ball of the foot. A shortening adjustment of the straps provides a change in the forward lean of the boot insert by pulling the upper highback portion forwardly toward the toe end of the heel cup foot bed portion of the boot insert.

Blax of Germany is currently selling a version of this type of highback soft boot insert under the trade name of I-SPINE. The Blax system utilizes a single direction tension adjustment via a ladder strap that runs vertically up the back of the ankle.

K-2 Corporation of Vashon, Wash. currently markets a product that utilizes a non-adjustable reinforcement in the construction of the boot. This is little more than the typical thermal formed heel "counter" material used in shoe making to make the heel area ridged and not wrinkle.

The ski industry has proposed and produced many solutions to this problem. However, none of these solutions are appropriate for snowboarding applications since they also require locking out or restraint of the lateral ankle movement. While locking out the lateral ankle movement is essential for skiing, it is detrimental for snowboarding since lateral movement of the ankle is essential for performing even the most fundamental snowboarding maneuvers.

The present invention overcomes the above noted problems of the prior art by relocating the calf supporting highback structure of conventional strap bindings to the inside of the soft style snowboard boot. Just as in the case with conventional high back strap bindings, the same functional criteria apply for the improved reinforced snowboard boot of the present invention, in that the internal boot support structure must be able to lock out a specific range of movement of the ankle in such a manner that forces exerted by the leg will be efficiently transferred through the matrix of boot, binding and board so that turn initiating leg movement results in a more positive and direct rotation of the snow board along its lengthwise axis.

SUMMARY OF THE INVENTION

Briefly, a preferred embodiment of the invention discloses an improved soft style snowboard boot which is internally reinforced by a multi-piece boot support assembly that includes a rigid molded plastic shank portion, a semi-rigid molded heel cup portion, and a molded or die-cut plastic highback portion. The shank portion is designed to resist flex, and provide ergonomic support for the foot, and further includes molded-in features which permit positive mechanical fastening of conventional step-in binding attachment structure, such as bail members or cleats, to the bottom or outsole of the boot.

A pair of length adjustable tensioning strap members are connected between the shank and highback portions of the boot support assembly. The tensioning straps are operative to induce a desired forward lean in the highback portion by pulling them tight and securing them in place. The straps may be tightened independently of each other to provide a desired side bias, left or right, to the highback portion.

The straps may be contained within the outer boot portion of the snowboard boot or may be exteriorly routed through slots provided in the outer boot portion for more convenient tension and/or release adjustment to the forward lean of the highback portion.

The heel cup portion is mechanically fastened to the shank portion. This intermediate piece supports the highback, but is also designed to provide a forward flexing or hinging motion at the ankle joint, thus mimicking the rider's natural ankle rotation. In addition, the heel cup portion locates and holds the heel in a fixed position, thus preventing "heel lift" which is detrimental to the control of the system.

The highback portion is mechanically fastened to the heel cup via a matrix of adjustable holes or slots provided in the highback portion. The highback portion can be repositioned to the right or to the left, or can be fastened in such a way so as to allow the highback portion to pivot from side to side by simply removing one or more fasteners. The alternate biasing of the highback portion provides the rider with the option of selectively rotating the "spine" of the ankle support system in such a way that either forward ankle movement (straight back to front) is primarily resisted by the center position, or lateral ankle movement (side to side, diagonally back to front) is the primary force resisted by a left or right positioning of the highback.

In another embodiment of the invention, a reinforced linerless snowboard boot is proposed wherein the tensioning straps are located entirely on the boot exterior, extending from an anchor point along either side of a forward portion of the boot upper (at about the instep or ball of foot region) to respective left and right sides of the upper boot shaft. The stiffness of the material of the boot in the boot upper region transmits force between the binding/shank portion interface and the boot shaft. In yet another embodiment of the invention, the boot support assembly is located on the exterior of the boot.

From our own experiences in the field, we have found that the absence of a dynamic support structure for a soft style snowboard boot gives rise to a phenomenon known as "flutter". Flutter occurs when the snowboard is moving at high speed under the influence of the terrain. This movement causes a loss of feeling or control by the rider. Simply adding more structure to existing step-in binding systems does not eliminate flutter and only serves to magnify the problem of unsupported areas.

Through careful analyses and inspection of prior art soft boot designs, we identified the areas of unsupported movement in the boot. We discovered that the type of structure applied to reinforce a particular area may solve a problem for one direction or plane (such as directly back (heel) ward, but not address combined forces which result in third dimension movement (forward+lateral=diagonal). The improved reinforced snowboard boot designs proposed herein describe several viable methods and apparatus for providing adjustable structure to support the three-dimensional movement that will accommodate all angular and rotational movements of the ankle.

Methods and apparatus which incorporate the features described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

DETAILED DESCRIPTION OF THE PREFERRED EMBODIMENTS

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
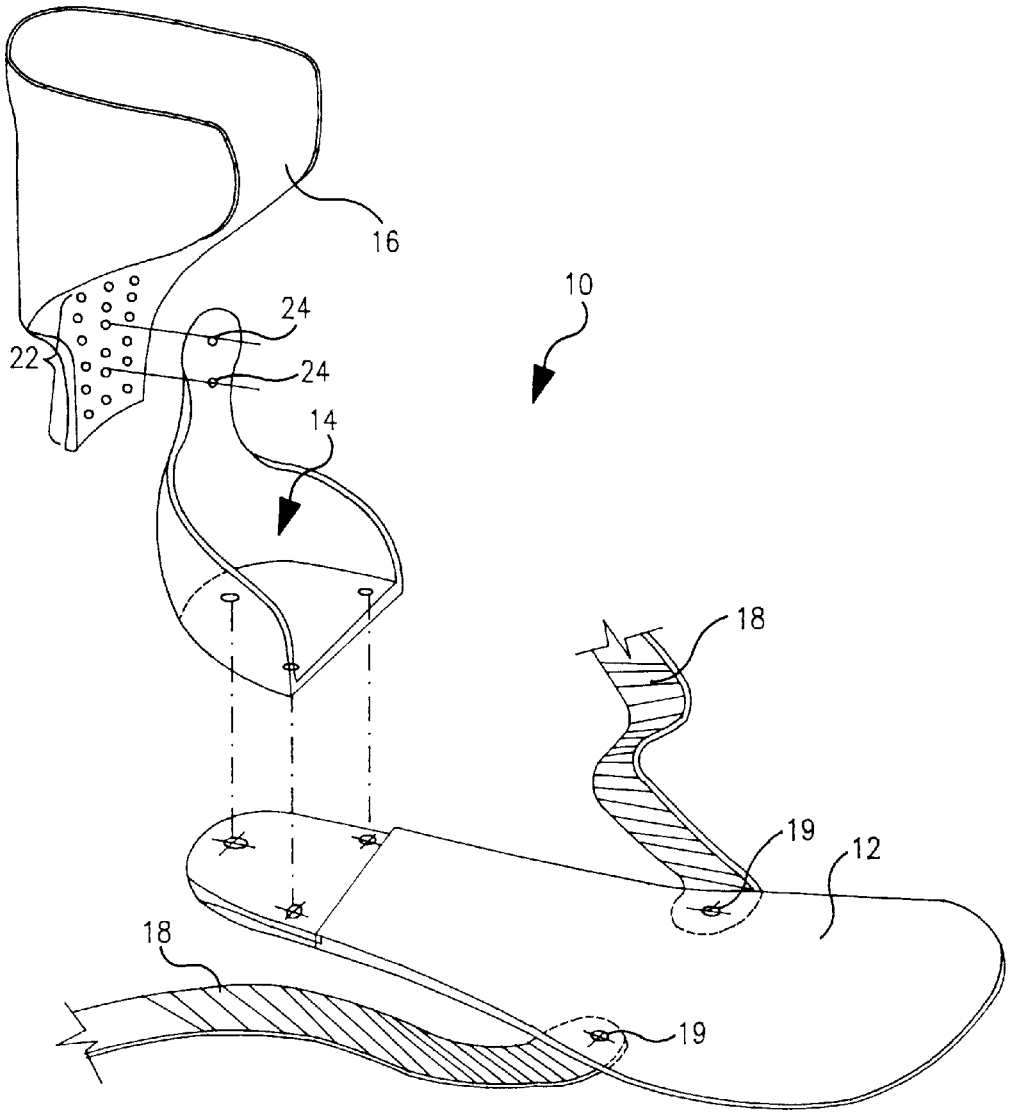
FIG. 1 is an exploded perspective view of an internal support assembly for a soft style snowboard boot in accordance with one embodiment of the present invention.
Figure 2:
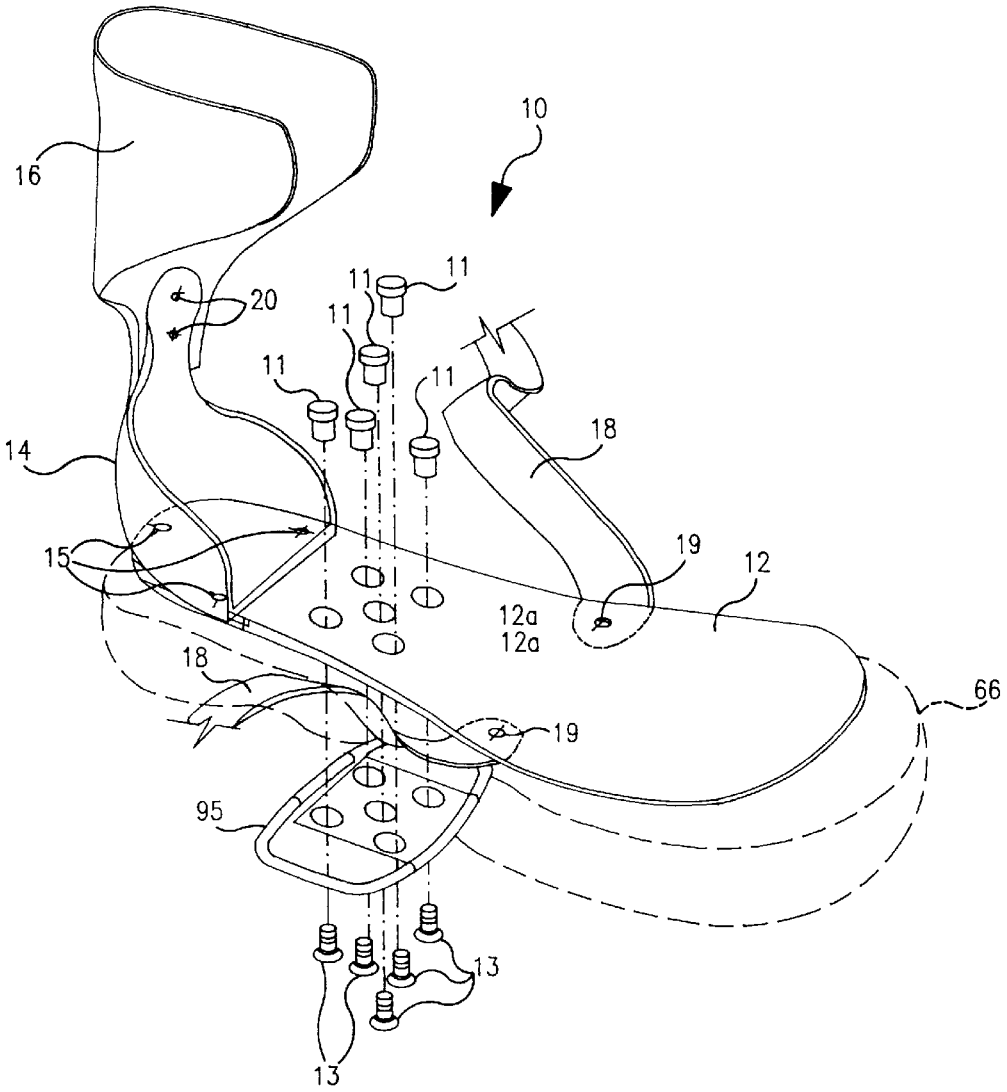
FIG. 2 is a perspective view of the support assembly illustrated in FIG. 1 and is shown fully assembled.
Figure 3:
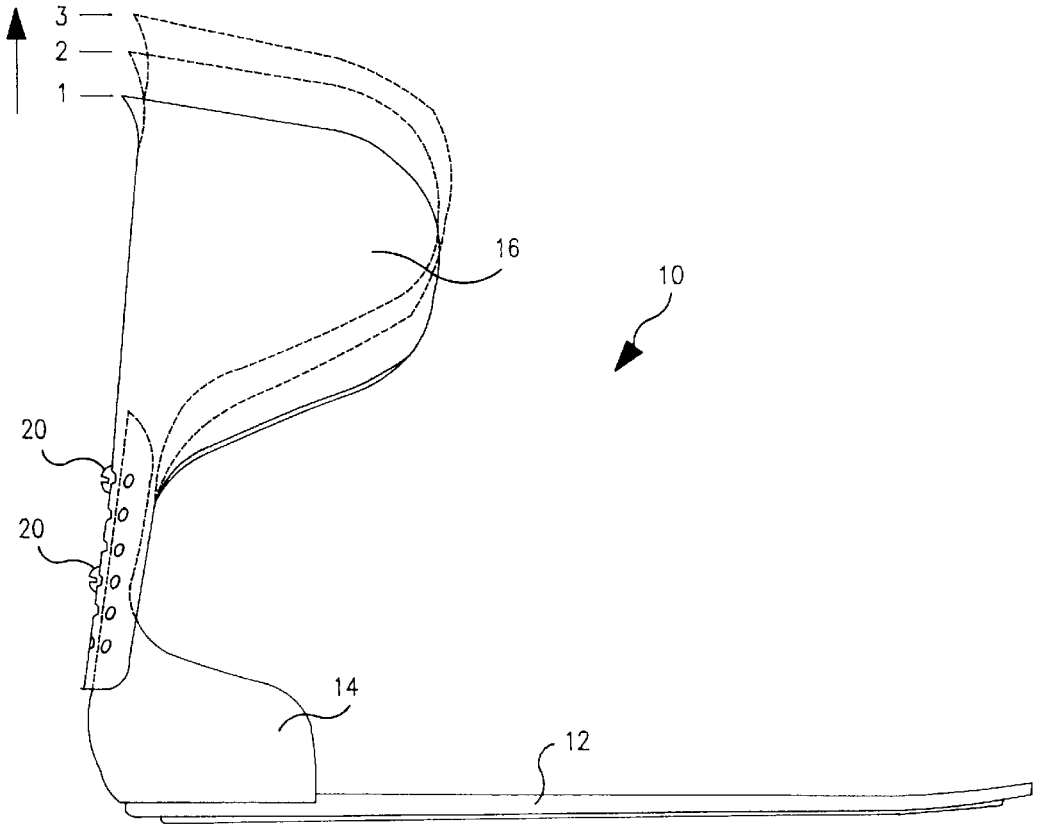
FIG. 3 is a side elevation view of the support assembly illustrated in FIG. 1.
Figure 4:
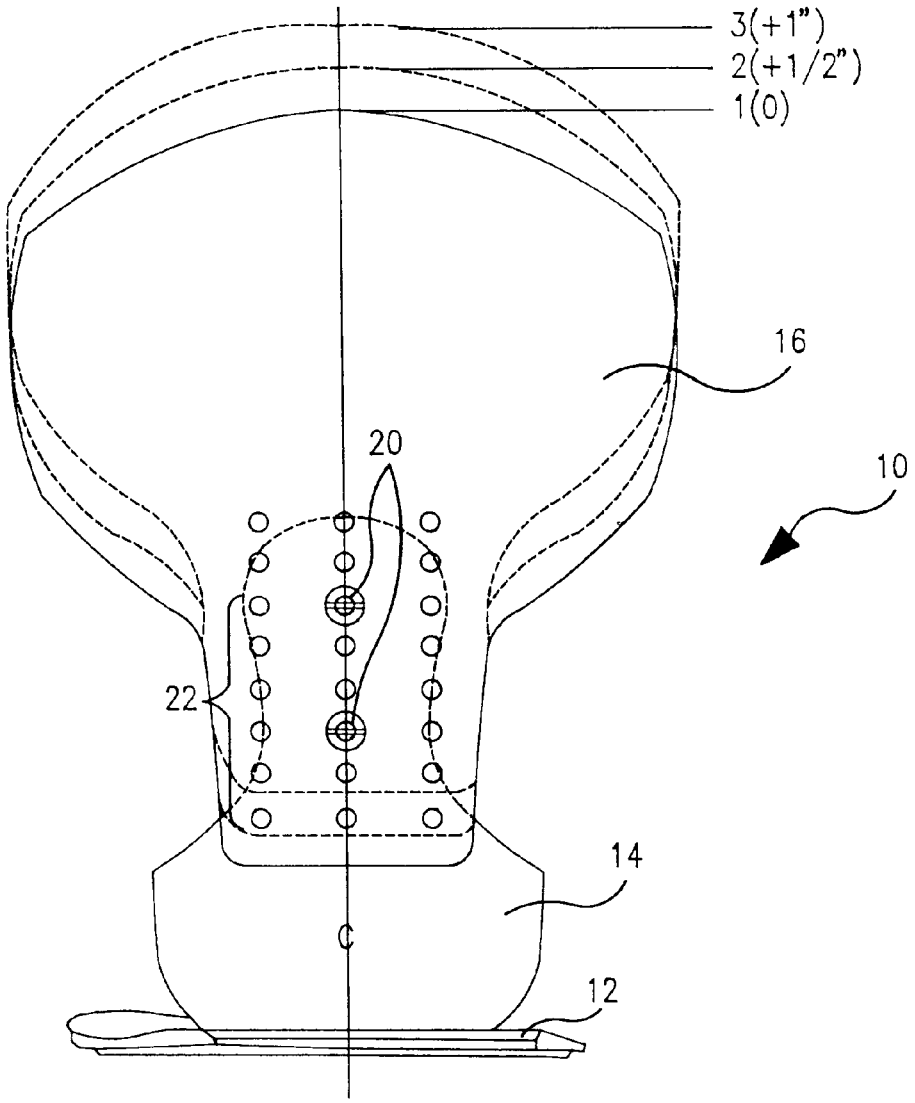
FIGS. 4–6 are a series of rear elevation views of the support assembly illustrated in FIG. 1 and which illustrate a highback adjustment feature of the invention.
Figure 5:
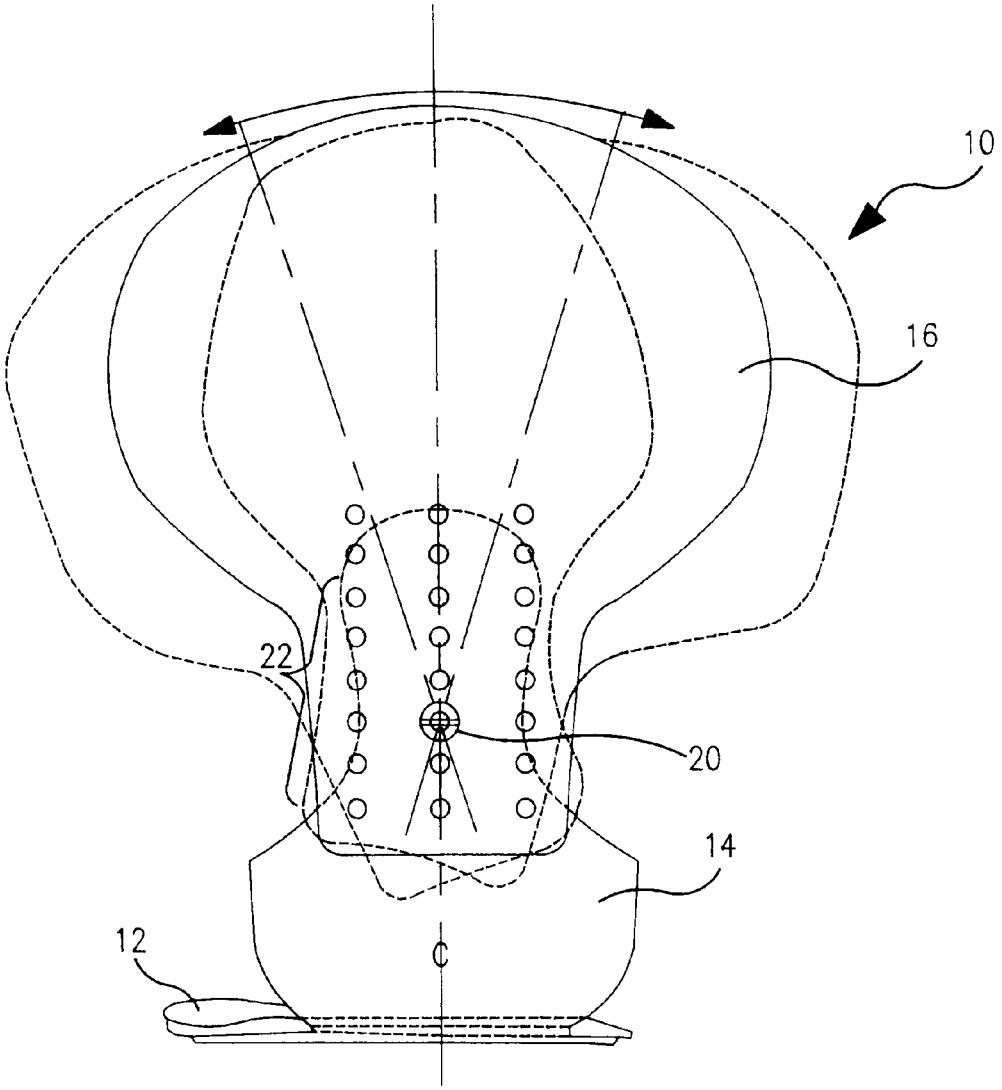
Figure 6:
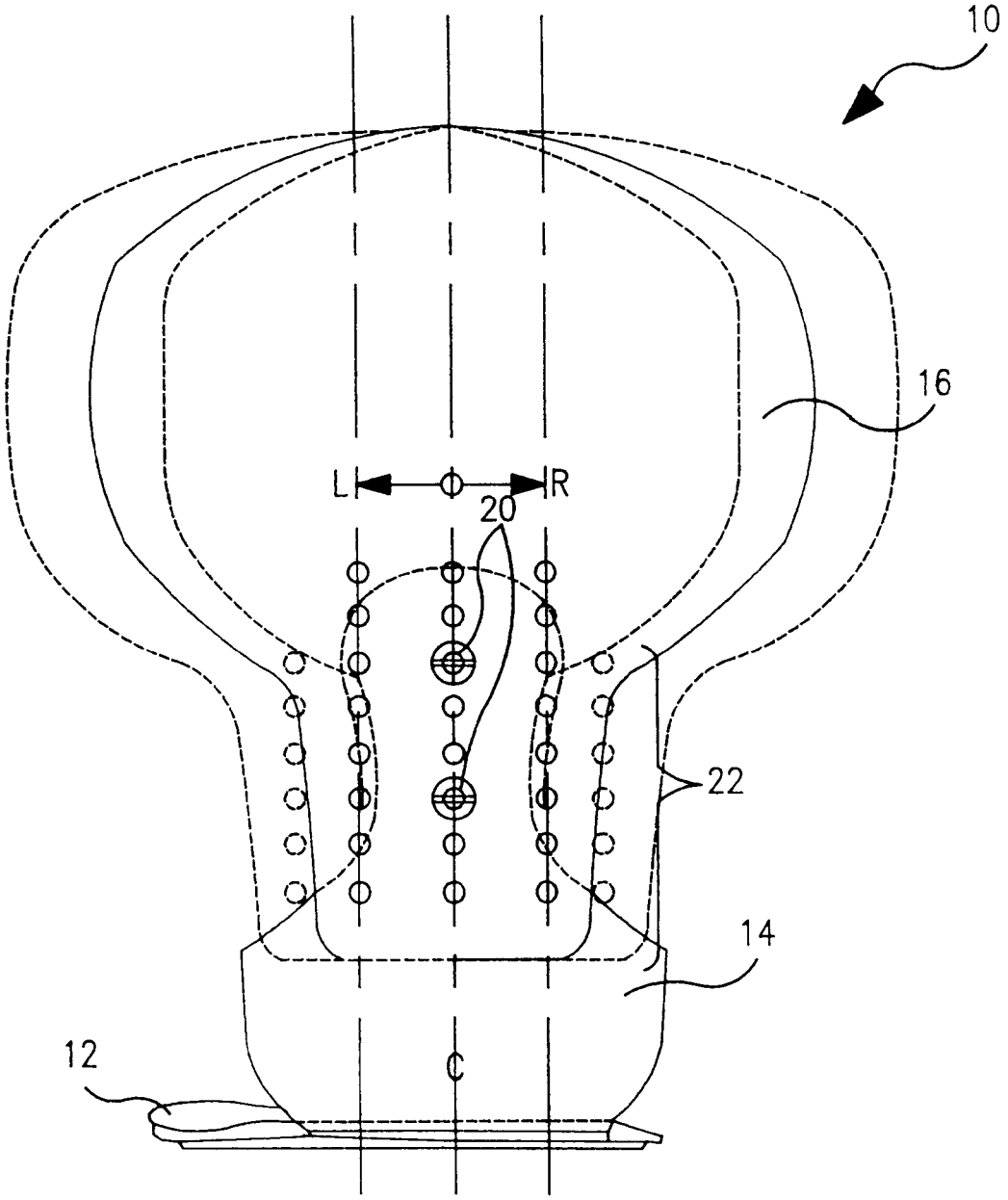

An ergonomic support assembly for a soft style snowboard boot is designated generally by reference numeral 10 in FIGS. 1 and 2. In the embodiment shown, the support assembly 10 forms an ankle support system which serves as the internal reinforcement for a soft style snowboard boot and is adapted to be positioned between the soft insulated inner boot portion and the flexible outer boot portion.

The support assembly 10 (hereafter "ankle support system") is a multi-piece assembly which includes a shank portion 12, a heel cup portion or counter 14, a highback portion 16 and straps 18.

The shank portion 12 is designed as a rigid member that resists flex and also provides ergonomic support for the foot. In a preferred embodiment, the shank portion 12 is made from a suitable molded plastic and has molded-in features that permit positive mechanical coupling with one or more binding attachment members provided to the outsole of a snowboard boot. As shown in FIG. 2, the molded-in features of the shank portion 12 preferably include holes 12*a* with recessed or counter sunk perimeter regions for receiving flush mounted screw or rivet fasteners 11 and 12 which extend through the outsole (shown in phantom and designated by reference numeral 66) to engage the step-in binding attachment member(s) 95. The outsole is defined as the outermost wear surface of a boot which is configured with a tread pattern (for traction) and an impression for receiving the attachment of one or more binding attachment members. The binding attachment member(s) 95 may be of any type used in commercially available step-in binding systems, including but not limited to, the side to side mounting bail mechanism of the type disclosed in U.S. Pat. No. 5,520,406 or the toe and heal binding attachment structure as disclosed in U.S. Pat. No. 5,505,477.

The shank portion is a structural member that is fixedly supported at its approximate midpoint to a snowboard by the binding attachment interface. In this way, the shank portion functions as a substantially rigid cantilever beam about its fixed midpoint.

The heel cup portion 14 supports the highback portion 16. The heel cup portion 14 is designed to provide a forward flexing or hinging motion at the ankle joint, thus mimicking the rider's natural ankle rotation. In addition, the heel cup portion 14 locates and holds the heel in a fixed position, preventing "heel lift" which is detrimental to the control of the ankle support system 10. The highback portion functions like a lever to provide a mechanical advantage which enables a rider to more easily tip (steer) a snowboard. The heel cup portion provides a structural compression member that transfers load from the highback portion down into the shank portion.

The heel cup portion 14 is preferably formed from a suitable thermoformable plastic material. The highback portion 16 may be made from suitable molded or die cut plastic materials. In one embodiment, the heel cup portion 14 is formed as a separate piece and is mechanically fastened to the shank portion 12 using conventional rivet or similar type fasteners 15. In an alternate embodiment (e.g., see FIG. 18), the heel cup portion may be formed integral with the shank portion.

The tensioning straps 18 are fastened by fasteners 19 to opposite sides of the shank portion 12 at about the instep/ball region of the foot. As will be discussed in more detail below, the straps 18 are used to link the shank portion 12 to the highback portion 16 or boot upper. The straps 18 are length adjustable and thus allow the user to set a desired amount of forward lean to the highback or boot upper. The straps 18 may also be length adjusted independently of each other thus enabling the user to selectively vary the amount of left-right bias in the forward lean of the highback or boot upper.

With reference to FIGS. 3–6, the connection between the highback portion 16 and the heel cup portion 14 will now be described. In accordance with a preferred embodiment, the plastic highback portion 16 is mechanically fastened to the heel cup portion 14 by aligning the through-holes 24 of the heel cup portion 14 with selected ones of the matrix of holes or slots 22 provided in the highback portion 16 and inserting fasteners 20 therethrough. In view of the matrix of holes/slots 24, the highback portion 16 can be repositioned up or down (see, e.g., FIGS. 3 and 4) or to the right or to the left (see, e.g., FIG. 6). Further still, the highback portion can be allowed to pivot from side to side by removing one or more fasteners 20 (see, e.g., FIG. 5). The alternate biasing of the highback portion 16 provides the rider with the option of selectively rotating the vertical axis or "spine" of the support system 10 in such a way that either forward ankle movement (straight back to front) is primarily resisted by the center position, or lateral ankle movement (side to side, diagonally back to front) is the primary force resisted by a left or right positioning of the highback portion 16.

Internal Strap Adjustment

Figure 7:
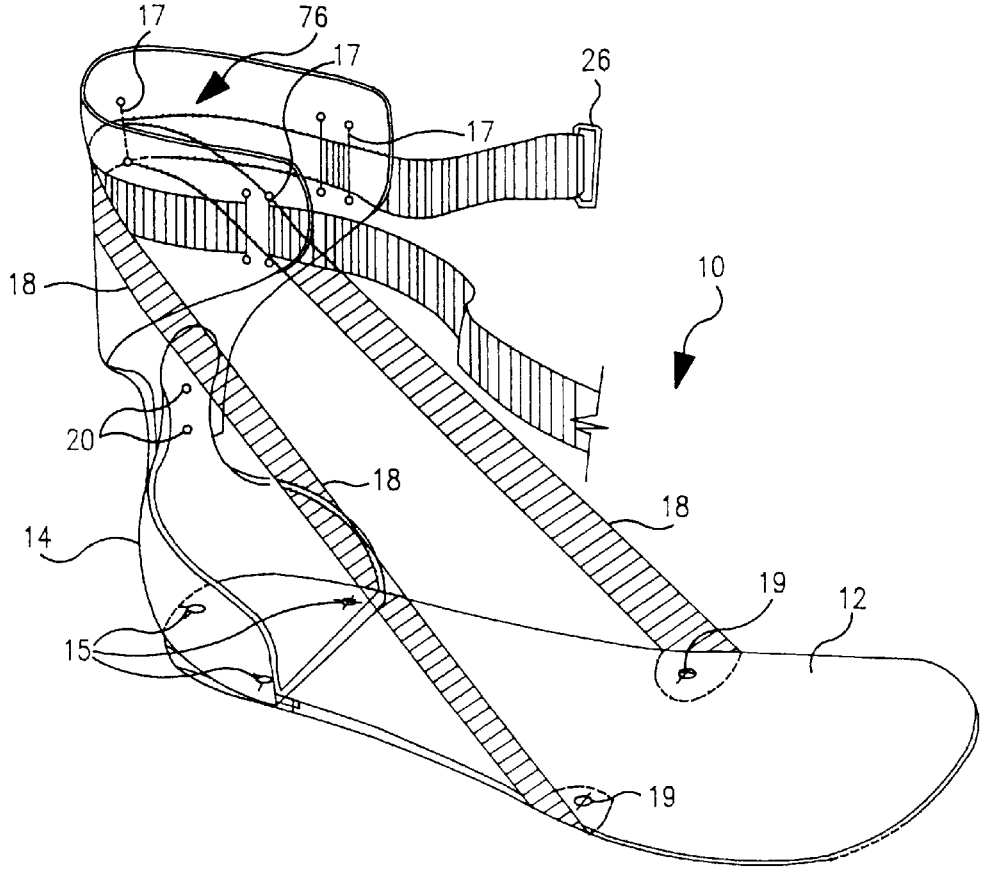
FIG. 7 is a perspective view of the support assembly illustrated in FIG. 1 and which is shown provided with a length adjustable tensioning strap assembly in accordance with one embodiment of the invention.
Figure 8:
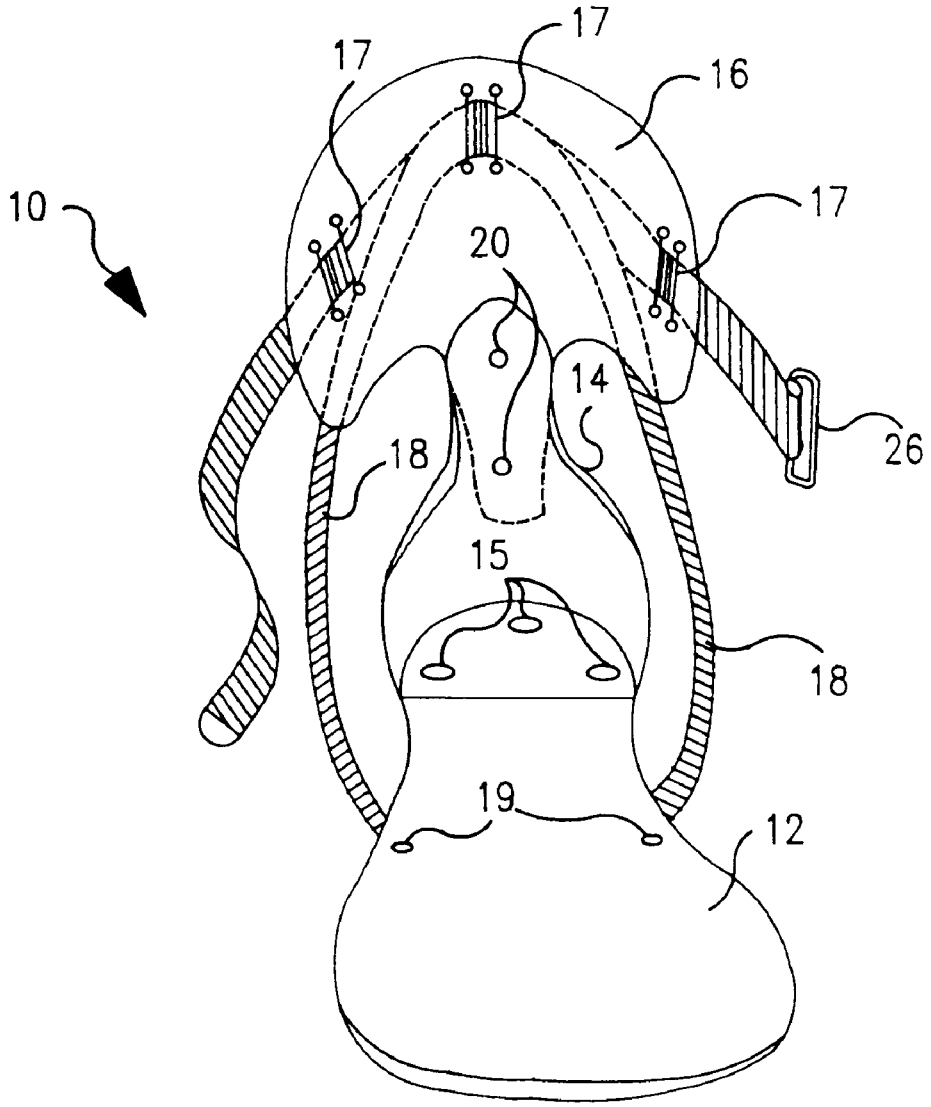
FIG. 8 is a front view of the support assembly and strap assembly illustrated in FIG. 7

In accordance with an internal strap adjustment embodiment shown in FIGS. 7–8, the tensioning straps 18 are connected to the highback portion 16 by threading the straps 18 through a series of slots 17 cut into the highback portion 16. In use, the forward lean position of the highback of the boot is set by the wearer of the snowboard boot prior to lacing up or otherwise closing of the outer boot portion of the snowboard boot. By pulling the straps 18 forward and securing them together with any type of common fastener or loop connection 26, a desired a forward incline of the highback portion is achieved. The user then closes up the outer boot portion by tightening the outer laces or straps as provided. The ends of the tensioning straps 18 may be provided with simple and reliable hook and loop type fasteners, such as Velcro™ fasteners.

Figure 9:
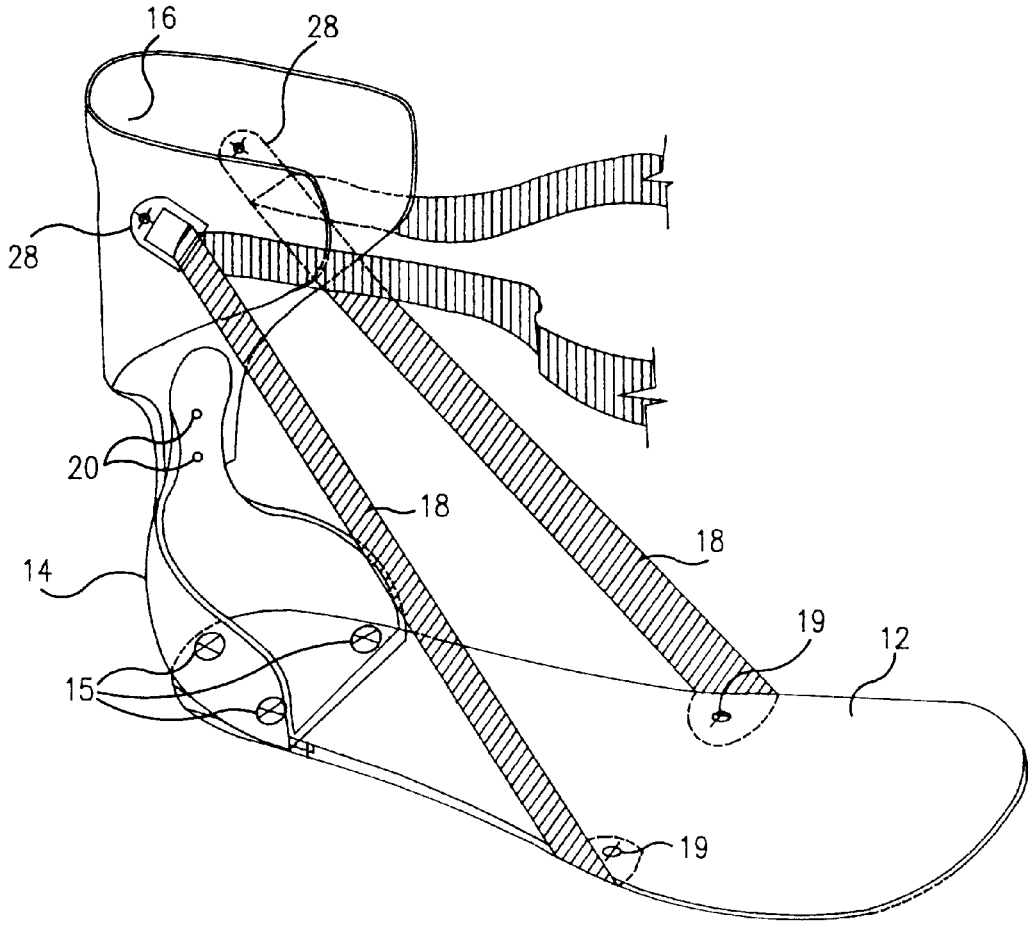
FIG. 9 is a perspective view of the support assembly illustrated in FIG. 1 and which is shown provided with a strap assembly in accordance with another embodiment of the invention.
Figure 10:
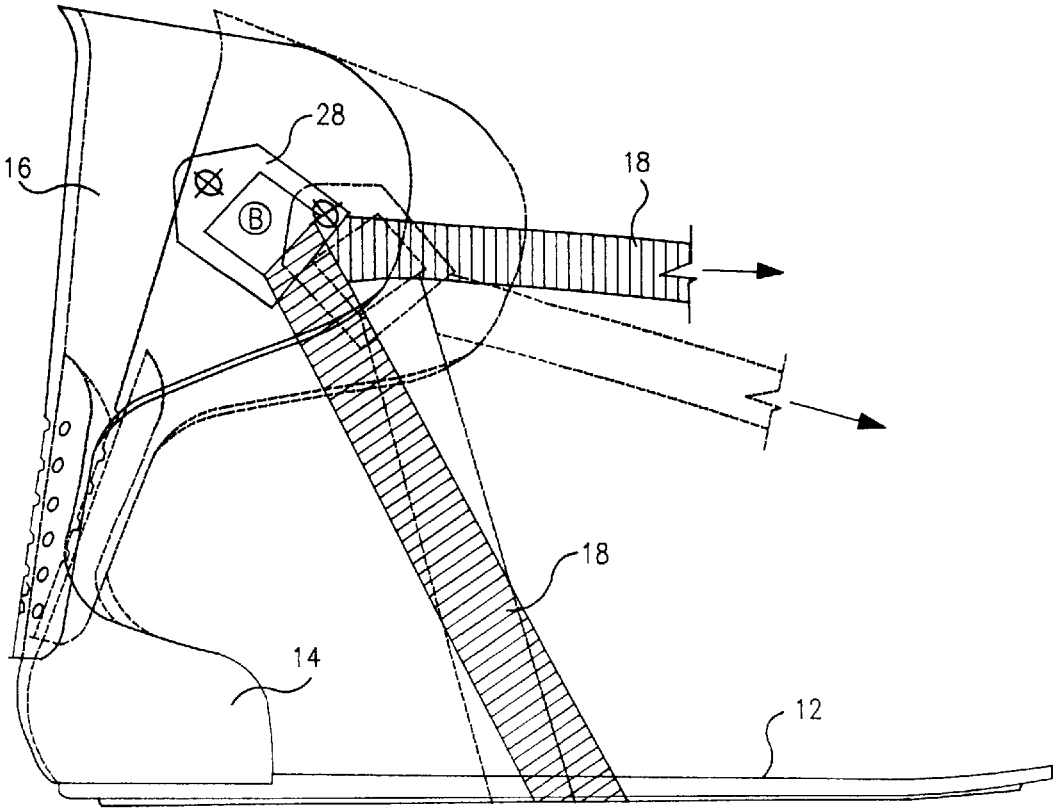
FIG. 10 is side elevation view of the support assembly and strap assembly illustrated in FIG. 9.

In accordance with another variation of the internal strap adjustment embodiment shown in FIGS. 9–10, the tensioning straps 18 can be linked to the highback portion 16 by guiding them through respective locking loops or turn buckles 28 mounted on both sides of the highback portion 16. Locking hardware for use in this embodiment may include, but is not be limited to, standard ladder locks, carn buckles, or even custom fabricated fasteners. As is best seen in FIG. 10, tightening the straps 18 by pulling them forward and locking the buckles produces a forward incline of the highback portion 16, either equally on both sides of the boot, or biased by pulling one strap 18 (ie., the left or right strap) more than the other.

External Strap Adjustment

Figure 11:
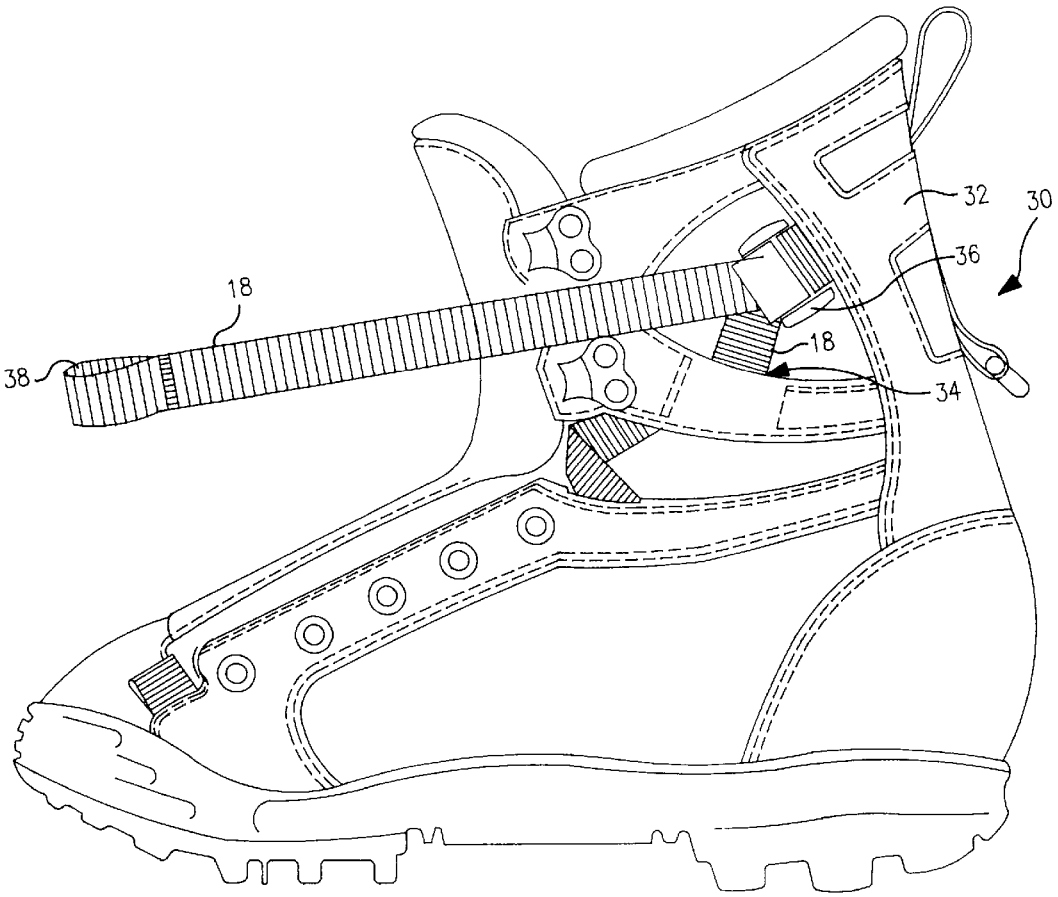
FIG. 11 is a side elevation view of a snowboard boot provided with an internal support assembly (hidden by the boot exterior) and an external strap assembly in accordance with another embodiment of the invention.

Referring to FIG. 11, an external strap adjustment embodiment of the invention is shown. FIG. 11 shows a snowboard boot 30 having a flexible outer boot portion or boot upper 32 within which the ankle support system 10 has been fitted (note most of the ankle support system 10 except for a portion of the tensioning strap 18 is hidden from view). In this embodiment, the straps 18 are threaded through the slots 17 provided on either side of the highback portion 16 (see FIGS. 7–8) and are then passed through to the outside of the boot 30 via openings 34 on both sides of the boot upper 32. Each strap 18 is then guided through a locking loop or buckle 36 that is mounted externally on both sides of the boot upper 36. This locking hardware may be either a standard ladder lock, cam buckle, or a custom designed fastener. Tightening the straps 18 by pulling them forward and locking the buckles produces a forward incline of the highback, either equally on both sides of the boot, or biased by pulling one strap more than the other. Adjustability of the highback without unlacing, opening or otherwise removing the boot is thus obtained. Each strap 18 may have finger loop 38 formed at its free end.

The above described strap adjustment allows the rider to selectively adjust the forward lean of the highback. Also, as noted above, the independent tightening adjustment of each strap 18 allows the rider to selectively bias the highback in two directions, both in forward lean (by tightening both straps, thus increasing the lean) and side to side angular orientation (by adjusting each strap independently, thus creating a biased forward lean). This structure conforms much more precisely to the rider's true ankle movements. In addition, the adjustability of the straps, which straps serve as compression members, adds to their role as tension members. This provides the rider with increased toe turn control. It is theorized that with this precise, adjustable structure, control over changes in snowboard direction are enhanced.

Figure 12:
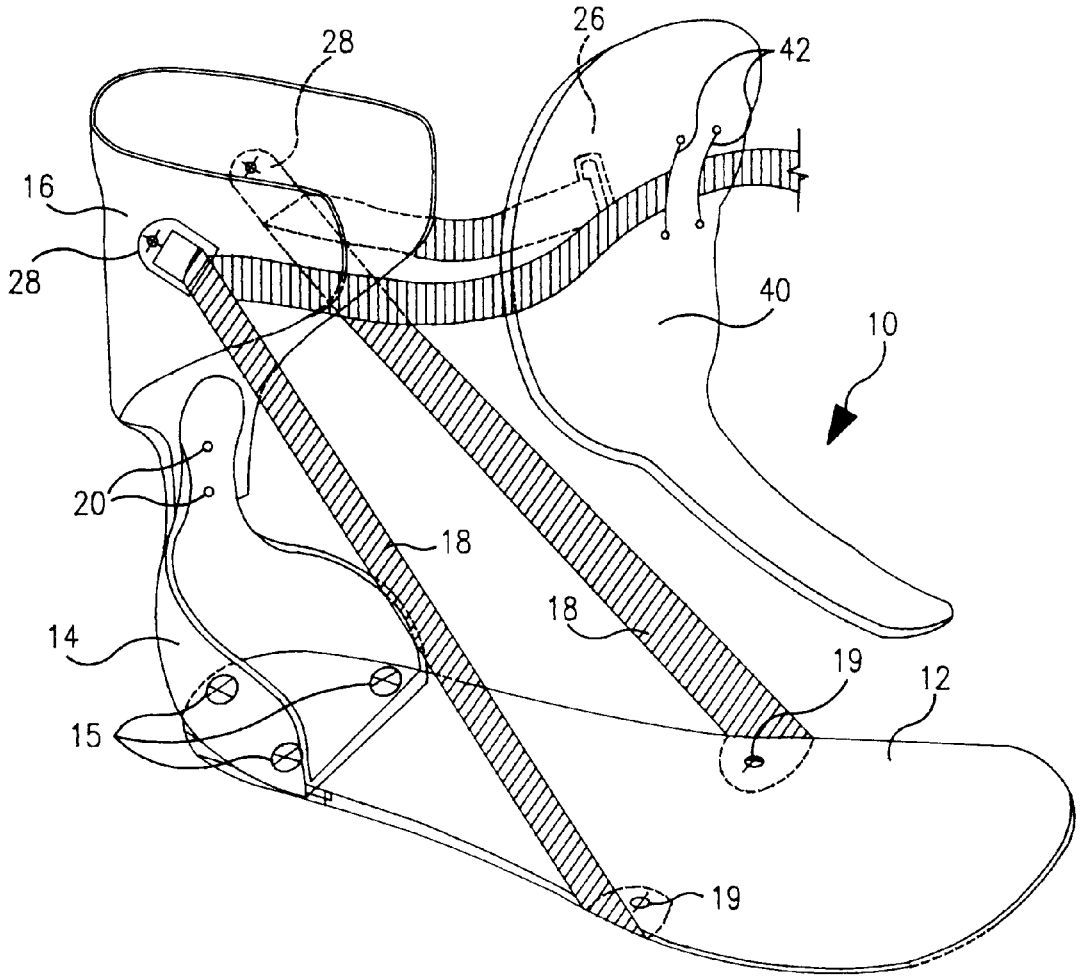
FIG. 12 is a perspective view of another embodiment of the invention which shows the support assembly and strap assembly and an additional tongue counter support.
Figure 13:
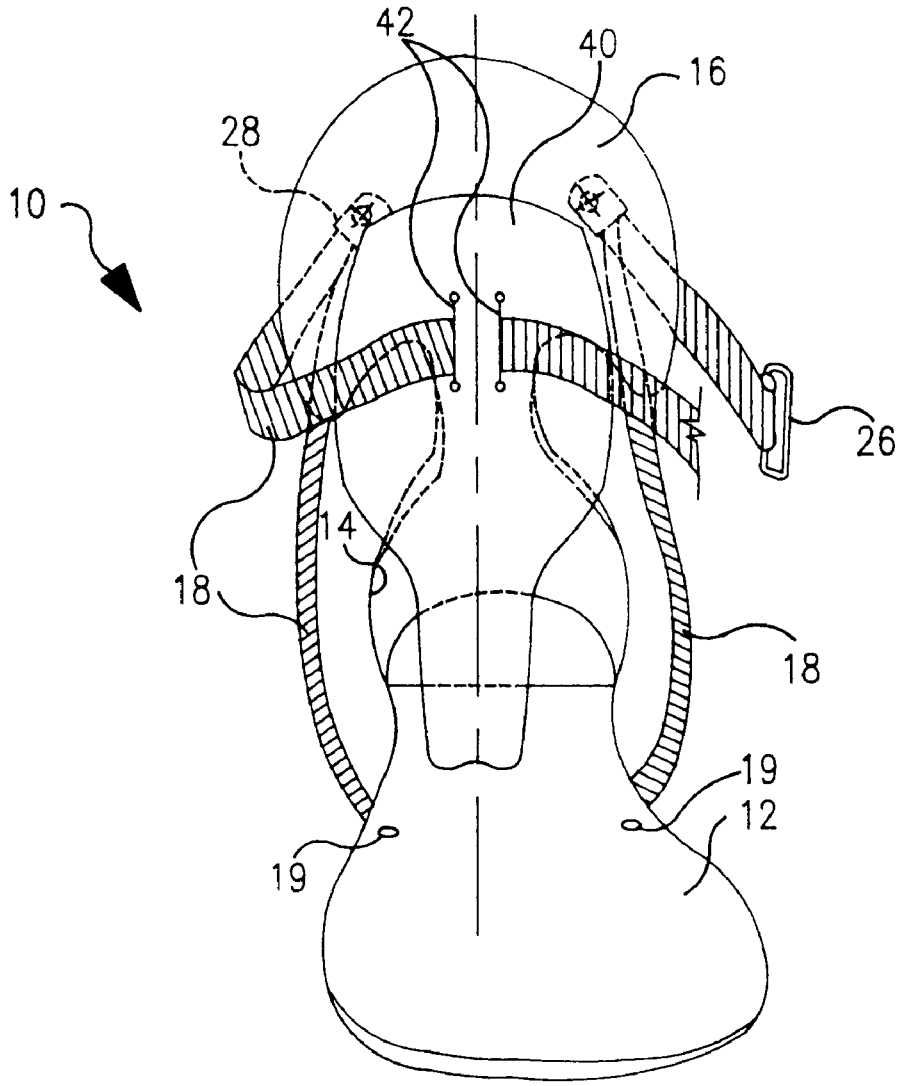
FIG. 13 is a front view of the embodiment illustrated in FIG. 12.

In accordance with the embodiment shown in FIGS. 12–13, the ankle support system 10 may optional include a thermo-formed plastic tongue counter 40 that is built into the padded area of the boot tongue. As used herein, the term "counter" is understood to mean a structural reinforcement member or stiffener. The tongue counter 40 includes a pair of slots 42 for routing one of the straps 18 therethrough provides additional forward lean support when assembled as shown As before, the entire system, which is mechanically fastened to the shank, is then mechanically connected to the binding via the binding attachment mechanism on the bottom of the boot, thereby providing direct transfer of all leg movement to the snowboard.

With reference to FIGS. 14–17*c,* an alternate embodiment which includes an optional rotatable heel cup will now be described. Structural elements of this embodiment that are common with structural elements in the previously described embodiments are indicated by the same reference numerals. Similar but modified structural elements are indicated by a prime symbol (') following the reference numeral.

Figure 14:
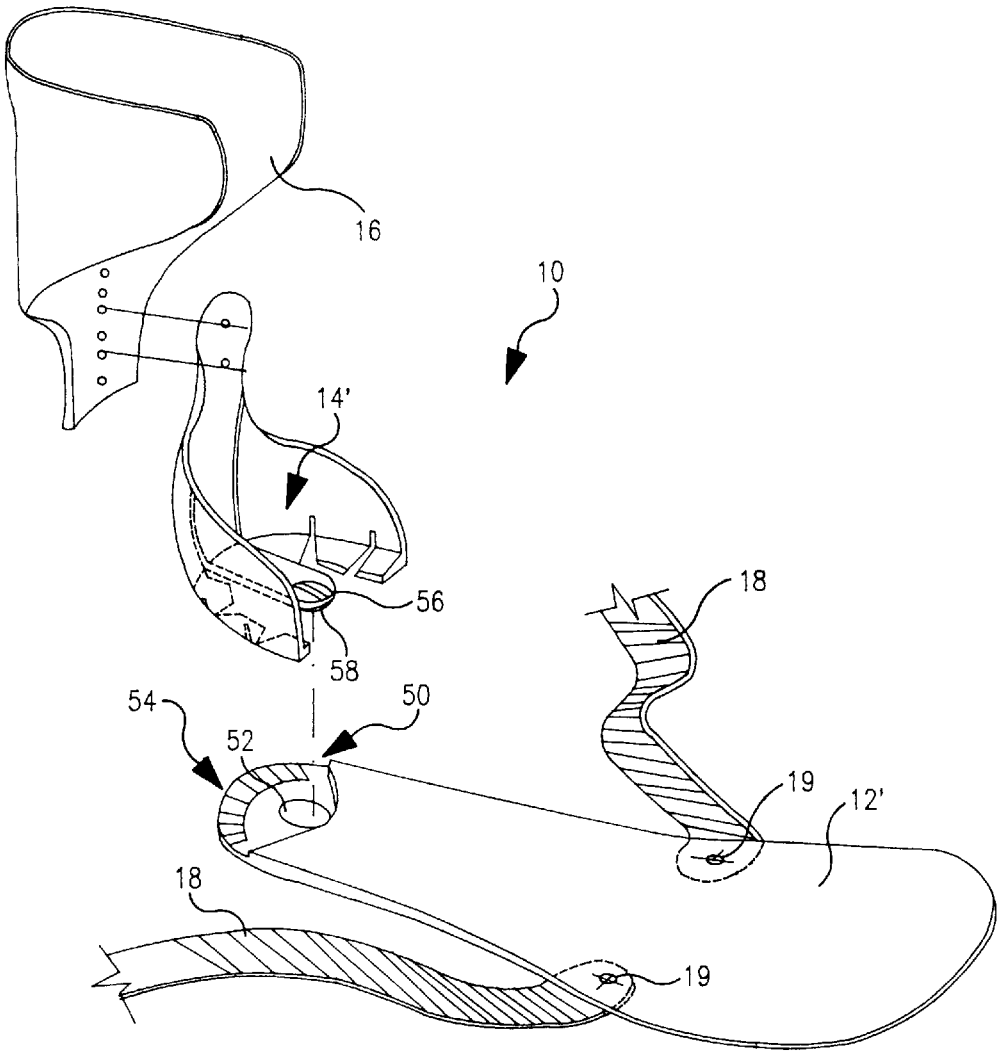
FIG. 14 is an exploded perspective view of another embodiment of the invention illustrating a rotatable heel cup feature.
Figure 15:
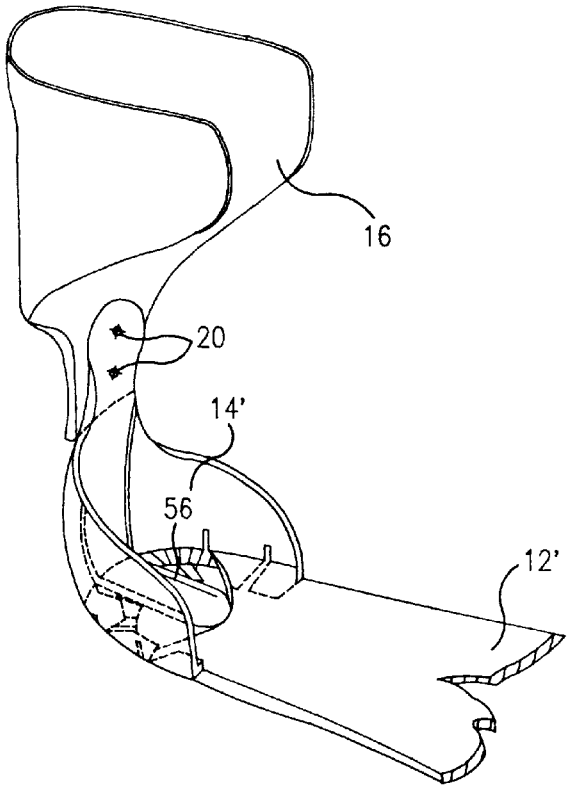
FIG. 15 is a fully assembled fragmentary perspective view of the embodiment of FIG. 14.
Figure 16:
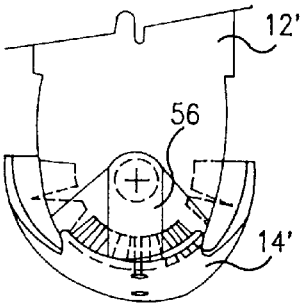
FIG. 16 is a top view of the embodiment shown in FIG. 14.

As best seen in FIG. 14, the shank portion 12' and heel cup portion 14' have each been modified along their respective interface regions. In particular, the shank portion 12' has molded-in features including a recessed region 50 with a hole 52 and a partial perimeter band of index score lines 54. The modified heel cup portion 14' includes tang member 56 with a protruding end 58 adapted for snap fit insertion within the hole 52 of the modified shank porion 12'. The modified features allows the modified molded plastic heel cup portion 14' to snap fit into the modified shank portion and rotate around the heel through a series of indexed positions. FIGS. 15–16 show the fully assembled engagement between the modified shank portion 12' and the modified heel cup portion 14'.

Figure 17A:
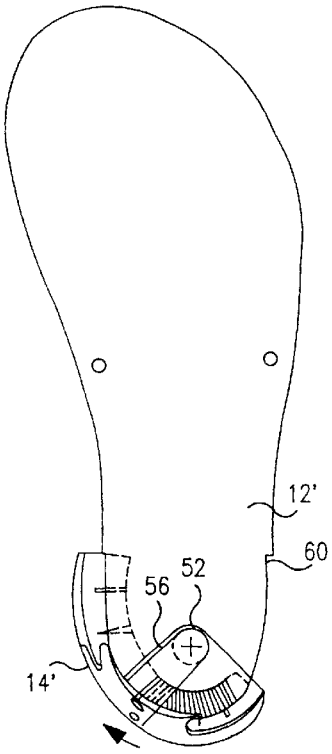
FIGS. 17*a*–17*c* is a series of top elevation views of the embodiment shown in FIG. 14 illustrating the range of left to right rotational motion of the rotatable heel cup.
Figure 17B:
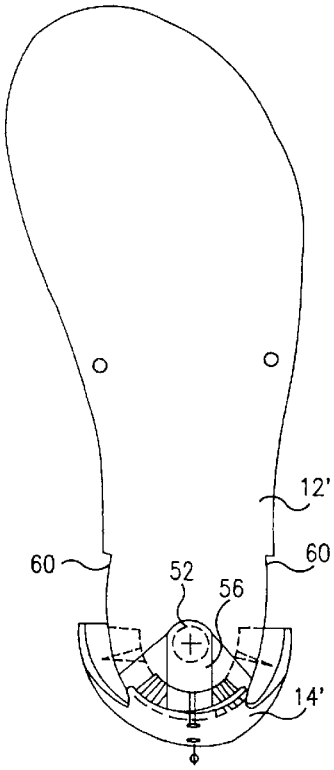
Figure 17C:
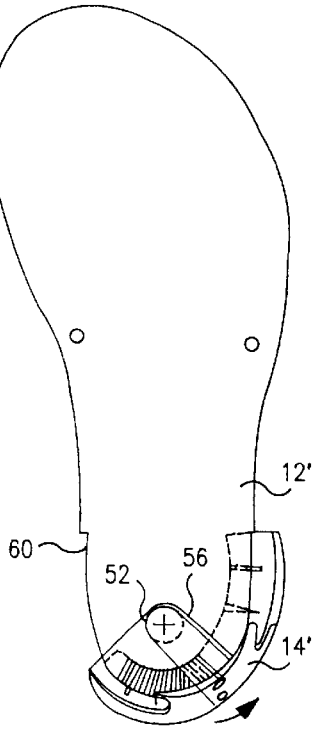

As is best seen in FIGS. 17*a*–17*c,* the modified shank portion 12' includes notched regions or wings 60 to accommodate the left to right indexed rotation of the modified heel cup portion 14' about the vertical pivot axis coordinate with the axis through hole 52. In FIGS. 17*a*–17*c* the highback portion 16 is not shown for clarity.

Figure 18:
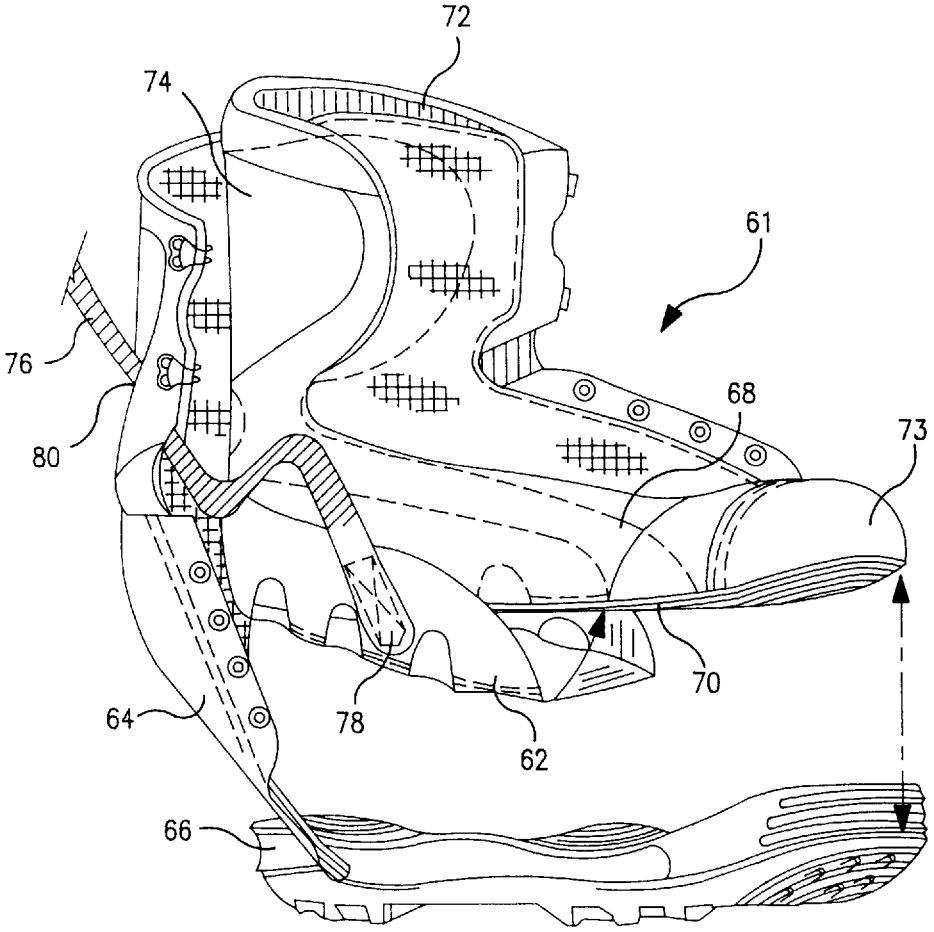
FIG. 18 is a cross-sectional perspective view of a linerless snowboard boot with an internal support assembly in accordance with another embodiment of the present invention.
Figure 19:
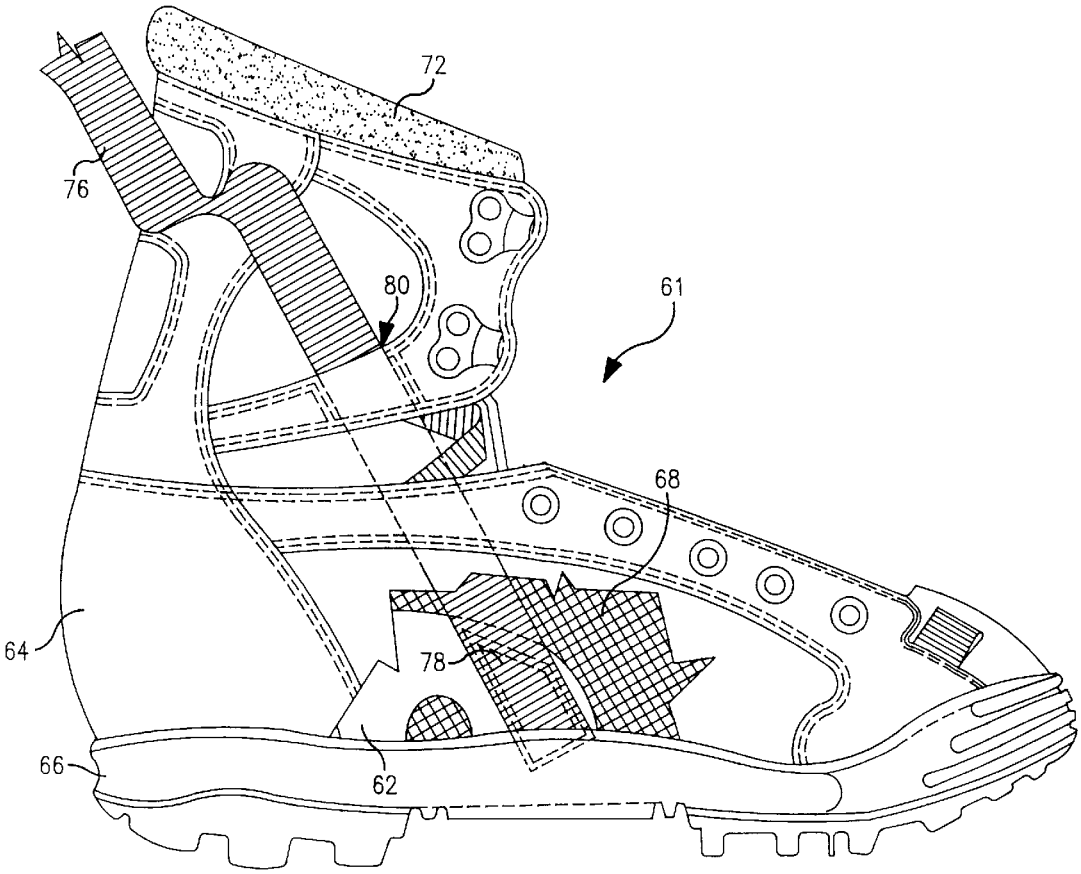
FIG. 19 is a side elevation view of the linerless snowboard boot embodiment illustrated in FIG. 18.

A linerless reinforced snowboard boot constructed in accordance with another embodiment of the present invention is designated by reference numeral 61 in FIGS. 18–19. The linerless reinforced snowboard boot 61 has the same functional characteristics of adjustable forward lean and bias control as in the previously described embodiments.

The linerless snowboard boot 61 is constructed in accordance with common construction methods for linerless style boots (ie., boots without a removable liner or motion control device). This construction additionally utilizes a one-piece, fixed internal combination highback and heel counter insert 62 preferably formed of thermo-formed plastic. The insert 62 is glued and/or sewn or otherwise affixed between the boot exterior material (ie. boot upper 64 and outsole 66) and the interior boot lining 68. The insert 62 may extend a partial to full length of the boot so as to function as the shank of the boot or may be utilized in addition to a shank already provided to the boot. The interior boot liner 68 is preferably made of fabric lined foam padding and includes a Texon™ board sole 70, a polyurethane foam collar 72, a toe piece 73, and a polyethylene highback counter 74 glued to the foam padding.

This linerless boot construction is combined with the adjustable strap system of the present invention, with the tensioning straps 76 internally fixed (eg , glued and/or sewn) to either side of the combination highback and heel counter insert 62 at an attachment point 78 located approximately at the instep to ball of foot region of the boot. The straps 76 are directed through openings 80 on either side of the boot upper 64, and are connected to a locking loop or buckle (not shown) mounted externally on both sides of the boot. For a description of the looking loop or buckle, refer to FIG. 11 and the previous discussion for the external strap adjustment.

As before, the choice for the locking hardware may include a variety of readily available components such as standard ladder locks or cam buckles. Alternatively, the locking hardware may be fashioned as custom designed fasteners. The fixed connection between the buckle location (external) and the highback (internal) permits direct adjustability of the highback and boot by pulling the straps forward and locking the buckle.

In another embodiment of the linerless reinforced snowboard boot, the shank portion is formed separate from the heel counter and is designed as an insert much like an insole piece. Also, the tensioning straps are placed exteriorly on the boot exterior with the lower end of each strap connected to a lower foot region or portion of the boot upper (adjacent the shoe lace receiving grommets). As before, the upper part of each strap is linked to respective lockable coupling members mounted on the left and right sides of the upper highback region of the boot upper such that tensioning of the straps causes the highback portion of the boot to move forwardly and induce a desired amount of forward lean.

Figure 20:
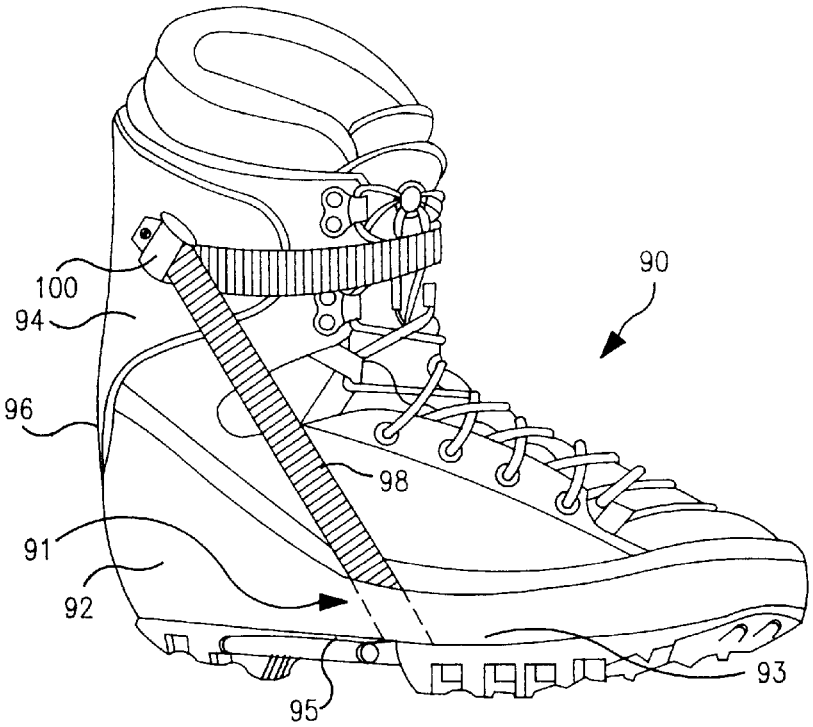
FIG. 20 is a perspective view of a snowboard boot provided with an external support assembly in accordance with another embodiment of the invention.
Figure 21:
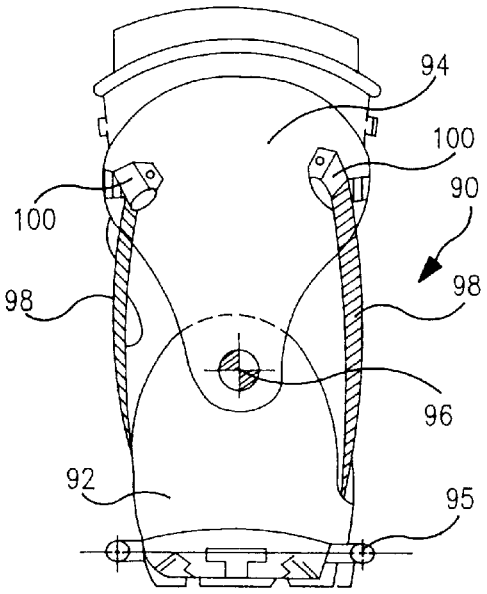
FIG. 21 is a rear elevation view of the snowboard boot with external support illustrated in FIG. 20.

FIGS. 20–21 illustrate a reinforced snowboard boot 90 provided with an all external support assembly in accordance with another embodiment of the invention. This embodiment provides the same functional characteristics for adjustment of forward lean and bias of the boot/ankle support as described in the previous embodiments.

The reinforced snowboard boot 90 comprise a single piece molded base support 91 which includes an integral heel cup and shank 92 all incorporated as part of the external construction of the boot 90. A molded highback support 94 is attached by a one central, pivoting fastener 96 to the back of the heel cup 92 of the base support 91. A binding attachment member 95 for use in combination with a step-in binding system is shown attached to the outsole of the snowboard boot 90.

As in the previously described embodiments, two tensioning straps 98 are provided to connect the shank portion 93 (at about the region of the instep) to a locking loop or buckle 100 mounted on both sides of the highback support 94. As mentioned above, this locking hardware 100 may comprise standard ladder locks, cam buckles, or custom designed fasteners. Tightening the straps 98 by pulling them forward and locking the buckles 100 produces a forward incline of the highback support 94, either equally on both sides of the boot, or biased by pulling one strap more than the other.

The above described embodiments fill a need for reinforced soft style snow board boots which are specially designed for use in combination with step-in bindings that do not offer highback support.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. An externally reinforced soft style snowboard boot of the type adapted to be provided with at least one binding attachment member for use in combination with a step-in snowboard binding system, said snowboard boot comprising:

a) a soft inner boot lining;

b) a flexible outer boot portion having an outsole and a boot upper having a foot portion and an ankle shaft portion;

c) a single piece molded base support formed integrally connected with said boot upper and said outsole, said base support including a heel cup portion and a shank portion, said shank portion adapted to receive fasteners for fastening said shank portion to at least one binding attachment member provided to said outsole of said outer boot portion and to prevent slippage of said shank portion to said inner boot lining and said outer boot portion and to provide improved transfer of leg movements of a wearer of said snowboard boot to a snowboard equipped with step-in bindings;

d) a highback support disposed adjacent a rear region of said ankle shaft portion of said boot upper, said highback support is pivotally connected to said heel cup portion of said base support; and e) a pair of tensioning strap members, each strap member having a first end connected to a respective left and right side of said shank portion of said base support at about an instep area of said shank portion, and a second end linked to a lockable coupling member mounted to respective left and right sides of said highback support, said strap members operative to be pulled through said lockable coupling members to produce a desired amount of forward lean in said highback support.

2. An externally reinforced soft style snowboard boot as in claim 1, wherein said strap members are independently length adjustable to provide a desired left or right side bias to a forward lean setting of said highback support.

3. A snowboard boot of the kind which includes a soft inner boot lining, a flexible outer boot portion having and outsole and a boot upper, said boot upper having a lower foot region and an upper highback region, and wherein said outsole is provided with at least one step-in binding attachment member mounted thereto for use in combination with a step-in snowboard binding, wherein the improvement comprises:

a) a pair of lockable coupling members mounted on respective right and left sides of said highback region of said boot upper;

b) a pair of length adjustable strap members, each strap member having a first end connected to a respective left and right sides of said lower foot region of said boot upper, and a second end connected to a respective one of said lockable coupling members; and c) said strap members operative to be pulled through said lockable coupling members to produce a desired amount of forward lean in said highback region of said snowboard boot.

4. A snowboard boot as in claim 3, wherein said strap members are independently length adjustable to provide a desired left or right side bias to a forward lean setting of said highback region.

5. An externally reinforced soft style snowboard boot for use in combination with releasable step-in snowboard binding systems, said snowboard boot comprising:

a) a soft inner boot lining;

b) a flexible outer boot portion having an outsole and a boot upper having a foot portion and an ankle shaft portion;

c) a single piece molded base support formed integrally connected with said boot upper and said outsole, said base support including a heel cup portion and a shank portion;

d) a highback support disposed adjacent a rear region of said ankle shaft portion of said boot upper, said highback support is pivotally connected to said heel cup portion of said base support;

e) a pair of tensioning strap members, each strap member having a first end connected to a respective left and right side of said shank portion of said base support at about an instep area of said shank portion, and a second end linked to a coupling member mounted to respective left and right sides of said highback support, said strap members operative to be pulled through said coupling members to produce a desired amount of forward lean in said highback support;

f) at least one binding attachment member configured for releasable engagement with a step-in snowboard binding; and g) at least one fastener for fastening said shank portion to said outsole and to said at least one binding attachment member to prevent slippage of said base support relative to said snowboard boot and to provide better transfer of leg movements of a wearer of said snowboard boot to a snowboard equipped with step-in bindings.

6. An externally reinforced soft style snowboard boot as in claim 5, wherein said strap members are independently length adjustable to provide a desired left or right side bias to a forward lean setting of said highback support.

7. A snowboard boot of the kind which includes a soft inner boot lining, a flexible outer boot portion having and outsole and a boot upper, said boot upper having a lower foot region and an upper highback region, and wherein said outsole is adapted to received at least one step-in binding attachment member mounted thereto for use in combination with a step-in snowboard binding, wherein the improvement comprises:

a) a pair of lockable coupling members mounted on respective right and left sides of said highback region of said boot upper;

b) a pair of length adjustable strap members, each strap member having a first end connected to a respective left and right sides of said lower foot region of said boot upper, and a second end connected to a respective one of said lockable coupling members;

c) said strap members operative to be pulled through said lockable coupling members to produce a desired amount of forward lean in said highback region of said snowboard boot;

d) a boot support assembly including a rigid shank and heel cup formed integral with said outsole and a highback formed integral with said boot upper;

e) at least one binding attachment member configured for releasable engagement with a step-in snowboard binding; and f) at least one fastener for fastening said binding attachment member to said shank and to said outsole to prevent slippage of said boot support assembly relative to said snowboard boot and to provide better transfer of leg movements of a wearer of said snowboard boot to a snowboard equipped with releasable step-in bindings.

8. A snowboard boot as in claim 7, wherein said strap members are independently length adjustable to provide a desired left or right side bias to a forward lean setting of said highback region.

* * * * *